US010513803B2

(12) United States Patent
Kim et al.

(10) Patent No.: US 10,513,803 B2
(45) Date of Patent: Dec. 24, 2019

(54) POLYETHYLENE FIBER, MANUFACTURING METHOD THEREOF, AND MANUFACTURING APPARATUS THEREOF

(71) Applicant: HUVIS CO. LTD., Seoul (KR)

(72) Inventors: Seong-Hoon Kim, Daejeon (KR); Jong-Hoon Park, Daejeon (KR); Dong-Hwan Cha, Daejeon (KR)

(73) Assignee: HUVIS CORPORATION, LTD., Seoul (KR)

( * ) Notice: Subject to any disclaimer, the term of this patent is extended or adjusted under 35 U.S.C. 154(b) by 238 days.

(21) Appl. No.: 15/540,677

(22) PCT Filed: Nov. 19, 2015

(86) PCT No.: PCT/KR2015/012496
§ 371 (c)(1),
(2) Date: Jun. 29, 2017

(87) PCT Pub. No.: WO2016/108429
PCT Pub. Date: Jul. 7, 2016

(65) Prior Publication Data

US 2018/0002833 A1 Jan. 4, 2018

(30) Foreign Application Priority Data

Dec. 31, 2014 (KR) ..... 10-2014-0195384

(51) Int. Cl.
*D01F 6/04* (2006.01)
*D01D 5/098* (2006.01)
(Continued)

(52) U.S. Cl.
CPC ..... *D01F 6/04* (2013.01); *D01D 5/098* (2013.01); *D01D 10/02* (2013.01); *D04B 1/24* (2013.01);
(Continued)

(58) Field of Classification Search
CPC . D01F 6/04; D04B 1/24; D01D 10/02; D01D 5/098; D02J 13/005; D02J 1/228;
(Continued)

(56) References Cited

U.S. PATENT DOCUMENTS 4,228,118 A * 10/1980 Wu ..... D01F 6/04 264/210.8
4,254,072 A * 3/1981 Capaccio ..... D01D 5/0885 264/210.3
(Continued)

FOREIGN PATENT DOCUMENTS

JP 11-229234 A 8/1999
JP 2014-534357 A 12/2014
(Continued)

*Primary Examiner* — Jeffrey M Wollschlager
(74) *Attorney, Agent, or Firm* — Weiss & Moy, P.C.; Jeffrey D. Moy

(57) ABSTRACT

The present disclosure relates to a polyethylene fiber and a method for preparing thereof, and more particularly to a polyethylene fiber, a method for preparing thereof, and an apparatus for preparing thereof, which has excellent wearing and touch sensation with processing convenience into woven fabrics and knitted fabrics in use in applied products by reducing the stiffness of fiber having the same physical properties using an enforced necking method in a spinning process.

5 Claims, 1 Drawing Sheet

(51) Int. Cl.

| | |
|---|---|
| ***D01D 10/02*** | (2006.01) |
| ***D04B 1/24*** | (2006.01) |
| ***D02J 1/22*** | (2006.01) |
| ***D02J 13/00*** | (2006.01) |

(52) U.S. Cl.
CPC ..... *D02J 1/228* (2013.01); *D02J 13/001* (2013.01); *D02J 13/005* (2013.01); *D10B 2321/021* (2013.01); *D10B 2401/062* (2013.01); *D10B 2501/00* (2013.01)

(58) Field of Classification Search
CPC ..... D02J 13/001; D10B 2501/00; D10B 2321/021; D10B 2401/062
See application file for complete search history.

(56) References Cited

U.S. PATENT DOCUMENTS 4,415,522 A * 11/1983 Capaccio ..... D01D 5/0885 264/210.8
4,691,003 A * 9/1987 Sze ..... D01F 6/62 528/308.1
4,902,461 A * 2/1990 Schippers ..... D02J 13/001 264/103
4,909,976 A * 3/1990 Cuculo ..... D01D 5/088 264/211.15
5,087,401 A * 2/1992 Yokoyama ..... D01D 5/16 264/130
5,182,068 A * 1/1993 Richardson ..... D01D 5/084 264/210.8
5,593,705 A * 1/1997 Schilo ..... D01D 5/092 264/177.19
5,698,146 A * 12/1997 Schippers ..... D01D 10/02 264/103
6,012,912 A * 1/2000 Gross ..... D02J 13/005 425/66
7,141,301 B2 * 11/2006 Sakamoto ..... D01F 6/04 428/364
2004/0062926 A1 * 4/2004 Sakamoto ..... D01F 6/04 428/364
2010/0122517 A1 * 5/2010 Simmelink ..... D01D 5/04 57/200
2011/0138516 A1 * 6/2011 Fukushima ..... D01F 1/10 2/159

FOREIGN PATENT DOCUMENTS

| | | |
|---|---|---|
| KR | 10-2003-0076014 | 9/2003 |
| KR | 10-06266130000 | 9/2006 |
| KR | 10-2014-0075842 | 6/2014 |

* cited by examiner

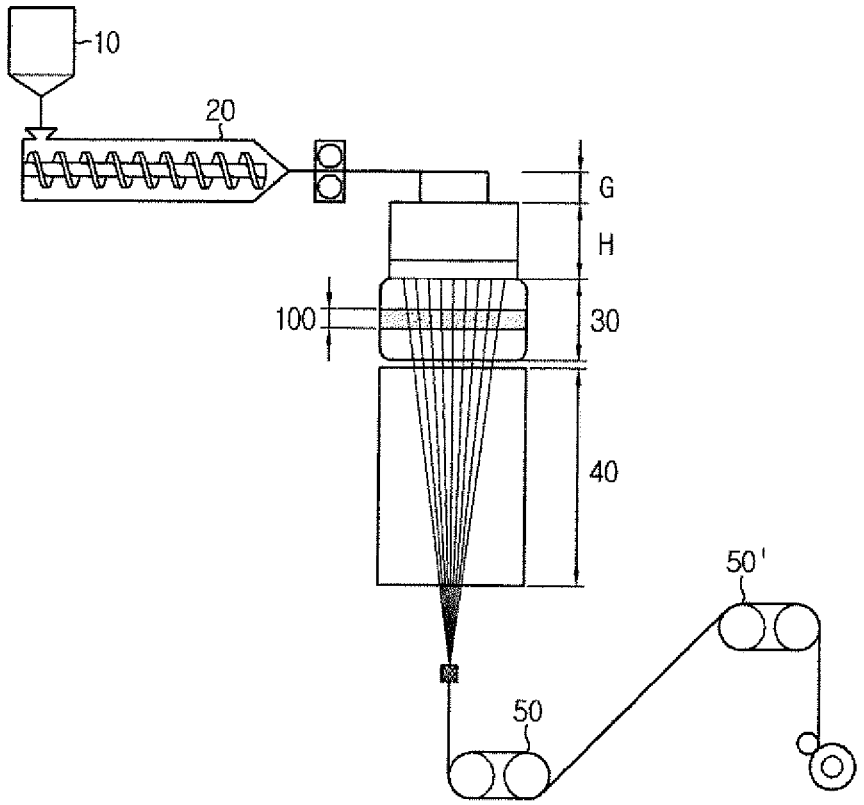
10
20
G
H
100
30
40
50'
50

POLYETHYLENE FIBER, MANUFACTURING METHOD THEREOF, AND MANUFACTURING APPARATUS THEREOF

TECHNICAL FIELD

This application claims the priority of Korean Patent Application No. 10-2014-0195384 filed on Dec. 31, 2014, in the Korean Intellectual Property Office, the disclosure of which is incorporated herein by reference.

The present disclosure relates to a polyethylene fiber, a method for preparing thereof, and an apparatus for preparing thereof, and more particularly to, a polyethylene fiber, a method for preparing thereof, and an apparatus for preparing thereof, applying enforced necking to a spinning process of the polyethylene fiber, having low stiffness while maintaining excellent cut-resistance, so as to provide excellent wearing and touch sensation with processing convenience on processing into, e.g., woven fabrics and knitted fabrics.

BACKGROUND ART

Polyethylene resins are classified into, e.g., high density polyethylene, low density polyethylene, and linear low density polyethylene. They are used as engineering plastics and films, and their fiber utilization is increasing for clothing and industrial use.

In recent years, an issue in the field of textiles is superfine fibers that exhibit high performance in extreme environments, such as aramid fibers, carbon fibers, and polyarylate fibers that require high strength and high elasticity. Among them, polyethylene-based superfine fibers are ultra high molecular weight polyethylene fibers having a molecular weight of several million or more.

The ultra high molecular weight polyethylene fibers having excellent strength and elasticity have a weight average molecular weight of several millions, so that they are manufactured through gel-spinning using an organic solvent, and they are also used in high strength applications such as bulletproof helmets, armor, ropes, and reinforcements that require abrasion resistance, chemical resistance, and cut resistance.

Polyethylene fibers having high strength and high-elasticity have excellent cut resistance in the form of woven fabrics and knitted fabrics. However, due to an increase in stiffness, there is an issue in that the processing convenience, wearing and touch sensation are lowered when they are applied to woven fabrics and knitted fabrics.

DISCLOSURE

Technical Problem

The present disclosure has been made to address the above-mentioned technical issues, and an object of the present disclosure is to provide a polyethylene fiber, a method for preparing thereof, and an apparatus for preparing thereof, which has low stiffness without deteriorating the physical properties and cut resistance of the polyethylene fiber.

Technical Solution

According to one aspect of the present disclosure, there is provided a method for preparing a polyethylene fiber, including the steps of: melt-extruding a polyethylene resin composition to obtain a polyethylene undrawn yarn; and passing the polyethylene undrawn yarn through a heated collar section with a process of enforced necking the polyethylene undrawn yarn in an enforced necking zone in the heated collar section.

The heated collar section may have a temperature in the range of 200° C. to 300° C.

The enforced necking zone may have a temperature higher by 50° C. to 100° C. than the surrounding heated collar section.

The method may further include the step of multi-step stretching the enforced necked polyethylene undrawn yarn using a fiber non-contact heating chamber which can control a temperature, Godet roller, or a combination thereof.

According to another aspect of the present disclosure, there is provided a polyethylene fiber obtained by the above-mentioned production method, having a stiffness index (k) of less than 2.5 and cut-resistance.

The polyethylene fiber may have a tenacity of 14 gf/d or more, and the fiber may satisfy a Max strain of 5.5% or more.

According to still another aspect of the present disclosure, there is provided an apparatus for preparing the polyethylene fiber, including a feeder for providing a polyethylene resin composition; an extruder for melt-extruding the polyethylene resin composition supplied from the feeder; and the heated collar section in which the melt-extruded polyethylene undrawn fiber passes and is maintained at a temperature of 200° C. to 300° C., in which the heated collar section contains the enforced necking zone maintained at a temperature higher by 50° C. to 100° C. than the ambient temperature.

There may be an air gap of 10 mm to 100 mm below the extruder nozzles.

Advantageous Effects

The polyethylene fiber according to the present disclosure is excellent in physical properties and cut-resistance, is low in stiffness and thus is flexible, has excellent processing convenience in processing into a woven fabric or knitted fabric, and excellent in touch feeling when worn on a human body.

DESCRIPTION OF DRAWINGS

The accompanying drawings merely illustrate exemplary embodiments of the present disclosure and serve to describe the principles of the present disclosure with the specification, but are not intended to limit the scope of the present disclosure.

Meanwhile, the shape, size, scale, or ratio of the elements in the drawings incorporated in the present specification may be exaggerated in order to emphasize a clear descriptions.

FIG. 1 is a schematic view of an apparatus for preparing polyethylene fibers according to an exemplary embodiment of the present disclosure.

BEST MODE

Hereinafter, the present disclosure will be described in detail. The terms and words used in the present specification and claims should not be construed as limited to ordinary or dictionary terms and should be interpreted as meaning and concept consistent with the technical idea of the present disclosure based on the principle that the inventor may properly define the concept of the term in order to best describe his or her own disclosure.

According to one aspect of the present disclosure, there is provided a method for preparing a polyethylene fiber, including the steps of melt-spinning a polyethylene resin composition to obtain a polyethylene undrawn yarn; and passing the polyethylene undrawn yarn through a heated collar section with a process of enforced necking the polyethylene undrawn yarn in an enforced necking zone in the heated collar section. The polyethylene fiber thus produced maximizes the fibrous tissue orientation by controlling the spinning draft in the enforced necking zone, so that it has excellent advantages of excellent tactile feel in the form of woven fabrics and knitted fabrics because the stiffness index related to the flexibility of the fiber is low while its cut-resistance is excellent.

The polyethylene resin composition usable in the present disclosure may contain polyethylene which is conventionally used in the art, so long as it is consistent with the object of the present disclosure.

As a non-limiting example of polyethylene, its repeating unit is preferably substantially ethylene. For example, it can include high-density polyethylene, and more preferably a polyethylene resin having a weight average molecular weight of 200,000 or less and a ratio (Mw/Mn) of weight average molecular weight to number average molecular weight of 5.0 or less.

In a range for achieving effects of the present disclosure, it may use copolymer of ethylene and a small amount of other monomers such as α-olefin, acrylic acid and its derivatives, methacrylic acid and its derivatives, vinylsilane and its derivatives as well as the homo-polymer of ethylene. They may also be blends between copolymers, an ethylene homopolymer and a copolymer, or further a homopolymer such as other α-olefins and a copolymer, and may have partial crosslinking.

The polyethylene resin composition may include components commonly used in the art. Non-limiting examples of the polyethylene resin composition may include a dispersant, a surfactant, and a polyester-based compound.

The polyethylene resin composition is melted in an extruder and discharged in a predetermined amount by a gear pump mounted on the extruder. Although the temperature inside the extruder is not specifically limited, since it is possible that the high-density polyethylene resin may form a fine gel by pyrolysis, oxidation and deterioration at a temperature higher than 320° C., it preferably melted at a temperature of 320° C. or less in order for easy spinning process. At this time, it is preferable to supply an inert gas to the extruder. The supply pressure of the inert gas may be preferably 0.001 MPa or more and 0.8 MPa or less, more preferably 0.05 MPa or more and 0.7 MPa or less, further preferably 0.1 MPa or more and 0.5 MPa or less.

The discharged polyethylene undrawn yarn passes through the heated collar section of 200° C. to 300° C. via an air gap of 100 mm or less below the spinning nozzle.

It is known in the art that fiber properties can be improved by increasing the fibrous tissue orientation in the longitudinal direction of the fiber. Specific methods for increasing the orientation are as follows.

Known are a method of increasing the orientation by regulating the discharging line speed and the spinning speed of the raw material discharged below the spinneret nozzle; a method of controlling the cooling time for cooling the raw material in the quenching process and the crystallization time of the molecule; and a method of increasing the orientation of the fiber through one or more stages of multi-step stretching method.

However, in the ease of increasing the fibrous tissue orientation in the longitudinal direction of the fibers by such methods, there is a problem that the spinning draft ratio at which the orientation is primarily initiated increases, but the tenacity thereof decreases to increase the fiber stiffness, or to lower the efficiency of multi-step drawing.

However, in one aspect of the present disclosure, the fibrous tissue orientation in the longitudinal direction of the fiber increases due to the enforced necking in the enforced necking zone included in the heated collar section.

As used herein, "enforced necking" is understood to mean maximizing fiber orientation by momentarily applying energy to intentionally cause necking the undrawn yarn in a predetermined zone, which is intended to achieve the structural orientation in the axial direction of the fiber.

According to one aspect of the present disclosure, the enforced necking zone includes an instantaneous heating device which has a temperature of 50° C. higher than the heated collar section, for example, in the range of 250° C. to 350° C., thereby providing enforced necking.

This enforced necking can produce the fiber having more orientation even under the same spinning tension, as the enforced necking zone is set such that the enforced orientation of the fibers is induced in the spinning draft process. Therefore, the fiber having improved stiffness can be produced under the same spinning draft and multi-step stretching conditions.

According to one aspect of the present disclosure, the spinning draft ratio is controlled to 110 to 160 by enforced necking.

In the present specification, the 'spinning draft ratio" is defined as follows.

Spinning draft ratio=Spinning velocity (Vs)/Discharging line velocity (V)

Then, the polyethylene undrawn yarn is cooled and solidified by a quenching apparatus in which the wind temperature and wind speed are controlled. This spinning process is preferably carried out at a low speed of from 100 m/min to 1,000 m/min.

Thereafter, the process may further include a step of multi-step stretching the enforced necked polyethylene undrawn yarn into two or more stages using a heating chamber capable of controlling a temperature, Godet roller, or a combination thereof. The stretching in the range of 110° C. to 125° C. is preferable for high-strength expression of the fiber.

In the present specification, the "total draft ratio" is defined as follows.

Total draft ratio=Spinning draft ratio×1 step draft ratio×Multi-step draw ratio

The polyethylene fiber according to one embodiment of the present disclosure thus obtained may have a stiffness index (k) ranging from 0 to less than 2.5.

In the present specification, the stiffness index (k) is defined as follows.

Stiffness Index ($k$)=tenacity (gf/denier)/Max strain (%)

The polyethylene fiber may further satisfy at least one of a tenacity of 14 gf/d or more, Max strain of 5.5% or more, and a cut-resistance of 10 or more in addition to the stiffness of the above-mentioned numerical range.

In the present specification, tenacity refers to a value obtained by grasping a fiber in a universal tester and applying a load at the above speed and tensing it to yield a stress-strain curve, the load at the time of cutting the tensed fiber is divided by a denier (G/d), and Max strain is defined as the percentage of the initial length for the stretched length until it is cut.

Hereinafter, the present disclosure will be described in more detail with reference to exemplary embodiments of the apparatus for preparing the polyethylene fiber appended to the present specification.

First, the polyethylene resin composition is supplied from the feeder 10 of the polyethylene resin composition to the extruder 20 through the injection port of the extruder 20. Although the temperature is not specifically limited depending on each part of the extruder, since the high-density polyethylene resin may form a fine gel by pyrolysis, oxidation and deterioration at a temperature of 320° C. or higher, it is preferable melted at a temperature of 320° C. or lower for a smooth spinning process.

The polyethylene resin composition is melted and discharged from the nozzle of the extruder 10, then passes through a gear pump G and a spinning head H, and then passes through the heated collar section 30 in the temperature range of 200° C. to 300° C., located below 100 mm from the extruder nozzle. At this time, the polyethylene undrawn yarn passes through the enforced necking zone 100 provided in the heated collar section 30, causing enforced orientation of the fiber.

Next, the enforced necked polyethylene undrawn yarn is cooled and solidified by a quenching device 40 whose the wind temperature and wind speed are controlled. It is preferable that the spinning of the polyethylene undrawn yarn is carried out at a low speed of 1,000 m/min or less.

Then, the polyethylene undrawn yarn is stretched in high magnification and multi-step through a non-contact heating chamber (not shown) capable of adjusting the temperature in the stretching process and a plurality of Godet rollers 50 and 50'. The stretching in the range of 110° C. to 125° C. is preferable for expression of high-strength for the fiber.

When several hundred to several thousands of polyethylene multifilament yarns pass through the non-contact heating chamber used in the stretching process without heated rollers, the surface friction is minimized, thereby reducing yarn defects and delivering uniform heat efficiency to multifilaments to allow multi-step stretching with high magnification.

Mode for Carrying Out Invention

Hereinafter, the present disclosure will be described in more detail with reference to Examples using the present disclosure. However, it is apparent to those skilled in the art that the scope of the present disclosure is not limited thereto.

EXAMPLE 1

A polyethylene resin was melted and extruded, and the fiber passed through the zone of 280° C. of a heated collar section below a nozzle under a discharge amount of 0.9 g/min/hole. Its orientation was forcibly increased in the enforced necking zone at 330° C., and the fiber was rapidly cooled at a quenching wind temperature of 20° C. or less. Polyethylene yarns were prepared by multi-step stretching process with the spinning draft ratio of 110 and the total draft ratio of 1760.

EXAMPLE 2

Polyethylene yarn was prepared in the same manner as in Example 1, except that the total draft ratio was 1980.

EXAMPLE 3

The fiber passed through the heated collar section below the nozzle so that its orientation was forcibly increased in the enforced necking zone. Polyethylene yarn was prepared by multi-step stretching process with the spinning draft ratio of 160 and the total draft ratio of 1920.

EXAMPLE 4

Polyethylene yarn was prepared in the same manner as in Example 3 except that the total draft ratio was 2240.

EXAMPLE 5

Polyethylene yarn was prepared in the same manner as in Example 3, except that the total draft ratio was 2560.

COMPARATIVE EXAMPLE 1

Polyethylene yarn was prepared in the same manner as in Example 1, except that the enforced necking zone was not used, and the total draft ratio was 1760.

COMPARATIVE EXAMPLE 2

Polyethylene yarn was prepared in the same manner as in Comparative Example 1, except that the total draft ratio was 1980.

COMPARATIVE EXAMPLE 3

The fiber passed through the heated collar section below the nozzle without the enforced necking zone. Polyethylene yarn was prepared by multi-step stretching process with the spinning draft ratio of 160 and the total draft ratio of 1920.

COMPARATIVE EXAMPLE 4

Polyethylene yarn was prepared in the same manner as in Comparative Example 3, except that the total draft ratio was 2240.

COMPARATIVE EXAMPLE 5

Polyethylene yarn was produced in the same manner as in Comparative Example 3, except that the total draft ratio was 2560.

Assessment Methods

In the present specification, the stiffness index (k) is defined as follows.

Stiffness Index ($k$)=Tenacity (gf/denier)/Max strain (%)

In the present specification, the tenacity and Max strain of the fiber refer to the values measured as follows.

The tenacity and Max strain of the fiber were measured by ASTM D-2256 using a universal testing machine UTM (Universal Testing Machine, INSTRON).

The value measured ten times at a rate of 300 mm/min under a measuring temperature of 20° C. and a relative humidity of 65% is defined by calculation as an average value for each of Tenacity and Max strain.

The method for evaluating the cut resistance of the woven fabric and knitted fabric follows the EN 388 standard. The circular blade with a constant load was rotated on the sample in a direction opposite to the running direction, and thus the sample was cut. When the circular blade contacted the metal plate under the sample to be cut, the sample was presumed to be cut, thereby finishing the test.

The index value for evaluating the cut-resistance is determined according to the round-trip distance of the circular blade, and the index value is calculated in the following manner.

TABLE 1

| Sequence | CControl specimen | TTest specimen | CControl specimen | IIndex |
|---|---|---|---|---|
| 1 | $C_1$ | $T_1$ | $C_2$ | $i_1$ |
| 2 | $C_2$ | $T_2$ | $C_3$ | $i_2$ |
| 3 | $C_3$ | $T_3$ | $C_4$ | $i_3$ |
| 4 | $C_4$ | $T_4$ | $C_5$ | $i_4$ |
| 5 | $C_5$ | $T_5$ | $C_6$ | $i_5$ |

$$\overline{Cn} = \frac{(C_n + C_{n-1})}{2}$$

$$I = \frac{1}{5}\sum_{n-1}^{5} i_n$$

$$i_n = \frac{(\overline{Cn} + Tn)}{\overline{Cn}}$$

The tenacity, Max Strain, stiffness index, and cut resistance of the polyethylene fibers obtained in Examples 1 to 5 and Comparative Examples 1 to 5 are shown in Tables 2 and 3 as below.

TABLE 2

| Section | Unit | Example 1 | Example 2 | Example 3 | Example 4 | Example 5 |
|---|---|---|---|---|---|---|
| Total draft | — | 1760 | 1980 | 1920 | 2240 | 2560 |
| Spinning draft | — | 110 | 110 | 160 | 160 | 160 |
| Tenacity | gf/d | 15.9 | 16.5 | 15.2 | 16.2 | 17.0 |
| Max Strain | % | 7.5 | 7.1 | 7.8 | 7.6 | 7.3 |
| Stiffness index (k) | — | 2.12 | 2.32 | 1.94 | 2.13 | 2.32 |
| Cut resistance (I) | — | 10.6 | 10.4 | 10.4 | 10.5 | 10.8 |

TABLE 3

| Section | Unit | Comparative Example 1 | Comparative Example 2 | Comparative Example 3 | Comparative Example 4 | Comparative Example 5 |
|---|---|---|---|---|---|---|
| Total draft | — | 1760 | 1980 | 1920 | 2240 | 2560 |
| Spinning draft | — | 110 | 110 | 160 | 160 | 160 |
| Tenacity | gf/d | 16.1 | 16.5 | 14.5 | 16.0 | 16.3 |
| Max Strain | % | 5.2 | 4.9 | 5.2 | 5.0 | 4.7 |
| Stiffness index (k) | — | 3.09 | 3.36 | 2.78 | 3.20 | 3.46 |
| Cut resistance (I) | — | 10.6 | 10.4 | 10.4 | 10.5 | 10.8 |

As seen from the above tables, the polyethylene fibers obtained in Examples each has a stiffness index k<2.5, which exhibits equal or better tenacity, Max strain, and cut-resistance with excellent flexibility and soft texture than the polyethylene fibers obtained in Comparative Examples.

The invention claimed is:

1. A method of preparing a polyethylene fiber, comprising the steps of:

melt-extruding a polyethylene resin composition to obtain a polyethylene undrawn yarn; and passing the polyethylene undrawn yarn through a heated collar section at a temperature in a range of 200° C. to 300° C. with a process of enforced necking the polyethylene undrawn yarn in an enforced necking zone centrally located in the heated collar section at a temperature 50° C. to 100° C. higher than the surrounding heated collar section.

2. The method of preparing a polyethylene fiber of claim 1, further comprising the step of multi-step stretching the enforced-necked polyethylene undrawn yarn using a fiber non-contact heating chamber which can control a temperature, Godet roller, or a combination thereof.

3. The method of preparing a polyethylene fiber of claim 1, further comprising spinning the polyethylene undrawn yarn at a speed equal to or less than 1,000 m/min.

4. The method of preparing a polyethylene fiber of claim 3, further comprising stretching the enforced-necked polyethylene undrawn yarn using a fiber non-contact heating chamber at temperature in a range of 110° C. to 115° C.

5. The method of preparing a polyethylene fiber of claim 1, further comprising positioning the heat collar section 100 mm below an extruder nozzle.

* * * * *